US007300049B2

(12) United States Patent
Brown et al.

(10) Patent No.: US 7,300,049 B2
(45) Date of Patent: Nov. 27, 2007

(54) FEED OF SHEET MATERIAL IN A FEEDER/SEPARATOR

(75) Inventors: Christopher J. Brown, Baldock (GB); Nicholas S. Clarke, Harpenden (GB); Martyn R. House, Puckeridge (GB); Paul L. Jeeves, Langford (GB)

(73) Assignee: Pitney Bowes Ltd., Harlow, Essex (GB)

( * ) Notice: Subject to any disclaimer, the term of this patent is extended or adjusted under 35 U.S.C. 154(b) by 392 days.

(21) Appl. No.: 11/034,370

(22) Filed: Jan. 12, 2005

(65) Prior Publication Data

US 2006/0151936 A1 Jul. 13, 2006

(51) Int. Cl.
*B65H 3/52* (2006.01)

(52) U.S. Cl. ..... 271/122; 271/126

(58) Field of Classification Search ..... 271/109, 271/113, 114, 116, 121, 122, 126, 125
See application file for complete search history.

(56) References Cited

U.S. PATENT DOCUMENTS 3,933,350 A * 1/1976 Mignano ..... 271/10.09
5,882,004 A * 3/1999 Padget ..... 271/119
6,082,729 A * 7/2000 Padget ..... 271/121
6,135,444 A * 10/2000 Padget ..... 271/121
6,217,017 B1 * 4/2001 Yamazaki ..... 271/121
6,663,098 B2 * 12/2003 Teo et al. ..... 271/121
2002/0185804 A1 12/2002 Wood et al. ..... 271/10.01

FOREIGN PATENT DOCUMENTS

GB 2 127 383 A 12/2002

* cited by examiner

*Primary Examiner*—Patrick Mackey
*Assistant Examiner*—Michael C McCullough
(74) *Attorney, Agent, or Firm*—Brian A. Collins; Angelo N. Chaclas

(57) ABSTRACT

A sheet feeder for feeding sheets one-at-a-time along a path is disclosed having: means for storing a plurality of sheets; a feeder/separator comprising feeding means for engaging the sheets and feeding them from the means for storing and a separator for engaging sheets fed by the feeding means to thereby feed single ones of the sheets one-at-a-time along the path whilst remaining sheets not being fed along the path are halted by the separator; and a clearance mechanism for engaging said remaining sheets and removing them from the separator region in a sheet clearance process.

14 Claims, 10 Drawing Sheets

FEED OF SHEET MATERIAL IN A FEEDER/SEPARATOR

FIELD OF THE INVENTION

This invention relates to an apparatus and method for feeding sheet material through a feeder/separator mechanism. In the following description, the terms "sheet(s)" or "sheet material" refer to material not only in the form of single-ply sheets, but also to folded sheets, envelopes, and to generally thin material which may be stacked.

BACKGROUND OF THE INVENTION

Many devices are known for automatically feeding sheet material in various forms into an envelope to form a mail package. A typical apparatus might take the form of a folder/inserter, wherein one or more sheets of printed paper are collated, folded and then fed into a waiting envelope. The envelope is supplied from another machine location to a waiting position where it is held open and awaits receipt of the folded sheet material thereinto. The envelope containing the folded sheets is then subsequently automatically sealed and ejected from the machine into a receiving bin or tray.

Traditionally, the use of such folder/inserter machines has been dominated by large organizations, for instance banks, utilities companies and Governments, who require a means for producing a large number of mailpieces addressed to specific individuals and each containing unique printed material therein, potentially private to the recipient. Machines employed for these purposes are typically extremely large, and operate at a very high throughput, i.e. they produce mailshots potentially comprising hundreds of thousands of individually-addressed mailpieces in a short amount of time. Organizations having a national or international audience might need to produce hundreds of thousands of such mailpieces in a single day.

However, folder/inserter machines are rapidly becoming more widely accepted amongst medium and small-sized businesses. Such businesses still require the capacity to produce a large amount of outgoing mail, but to a smaller audience. Further, such businesses are incapable of affording the associated costs of running and operating a highly complex mailing apparatus of the type described above. Instead, folder/inserter machines of reduced complexity, and of a size suitable for SOHO (small office/home office) operation have been developed. Such machines are typically capable of producing mailshots comprising from a few hundred to one or two thousand mailpieces. These machines must be able to readily accept paper in the size and format typically used within an office environment, and similarly must be able to store and fill envelopes of the types most commonly used in the SOHO environment. Therefore, a folder/inserter for the SOHO environment will typically have an envelope feeding mechanism capable of storing several hundred envelopes in a stack. These envelopes are subsequently fed to a feeder/separator which separates a single envelope from the stack and feeds it to a waiting position where the envelope is held open and the desired printed material is inserted thereinto.

Typically envelope feeders comprise a platform which can be raised and lowered. A plurality of envelopes are placed on the platform. In operation, the platform is raised to bring the top envelope in the stack to a position from which the top envelope in the stack is fed into a feeder/separator mechanism, and subsequently through the folder/inserter apparatus, as described above. With a conventional envelope feeding means, more than one envelope is fed to the separator from the top of the stack. The separator then ensures that envelopes are fed individually into the machine, whilst the remaining few envelopes are left in the inlet area of the separator. Thus, when the feeding operation is stopped, one or more envelopes may remain at the inlet to the separator. If the platform is then lowered, for example to replenish the stock of envelopes in the stack, these envelopes remaining at the inlet to the separator will typically hang down into the region of the runway along which the platform is raised and lowered, thereby obstructing raising of the platform.

In known prior art devices, the operator replenishing the supply of envelopes is then required to remove by hand these envelopes remaining at the inlet to the feeder/separator before normal feeding can resume. This represents an inconvenience to the operator, reduces the efficiency of operating the feeder/inserter apparatus, and may even lead to jams when the envelopes are not correctly removed.

SUMMARY OF THE INVENTION

According to the present invention, a sheet feeder is provided for feeding sheets one-at-a-time along a path comprising: a means for storing a plurality of sheets; a feeder/separator including (i) a feeding means for engaging and feeding the sheets from the storage means and (ii) a separator for engaging sheets fed by the feeding means to feed sheets one-at-a-time along the path whilst any remaining sheets not being fed are halted by the separator; and a clearance mechanism for engaging and removing the remaining sheets from the separator region in a sheet clearance process. The clearance mechanism includes at least one belt having a flipper attached thereto for engaging the remaining sheets to effect clearance of the sheets from the separator region.

According to a further aspect of the present invention, there is provided a method of feeding sheets one-at-a-time to a machine, comprising the steps of: (i) providing a plurality of sheets in a stack; (ii) engaging sheets in the stack with a feed roller and feeding them through a separator towards the machine; (iii) engaging sheets being fed through the separator with a separator roller to allow only a single sheet to be fed into the machine and halting remaining sheets at the separator; and (iv) operating a return mechanism to return any remaining sheets to the stack.

BRIEF DESCRIPTION OF THE DRAWINGS

For a better understanding of the invention and to show how the same may be carried into effect, reference will now be made, by way of example, to the accompanying drawings, in which.

DETAILED DESCRIPTION OF THE INVENTION

Figure 1:
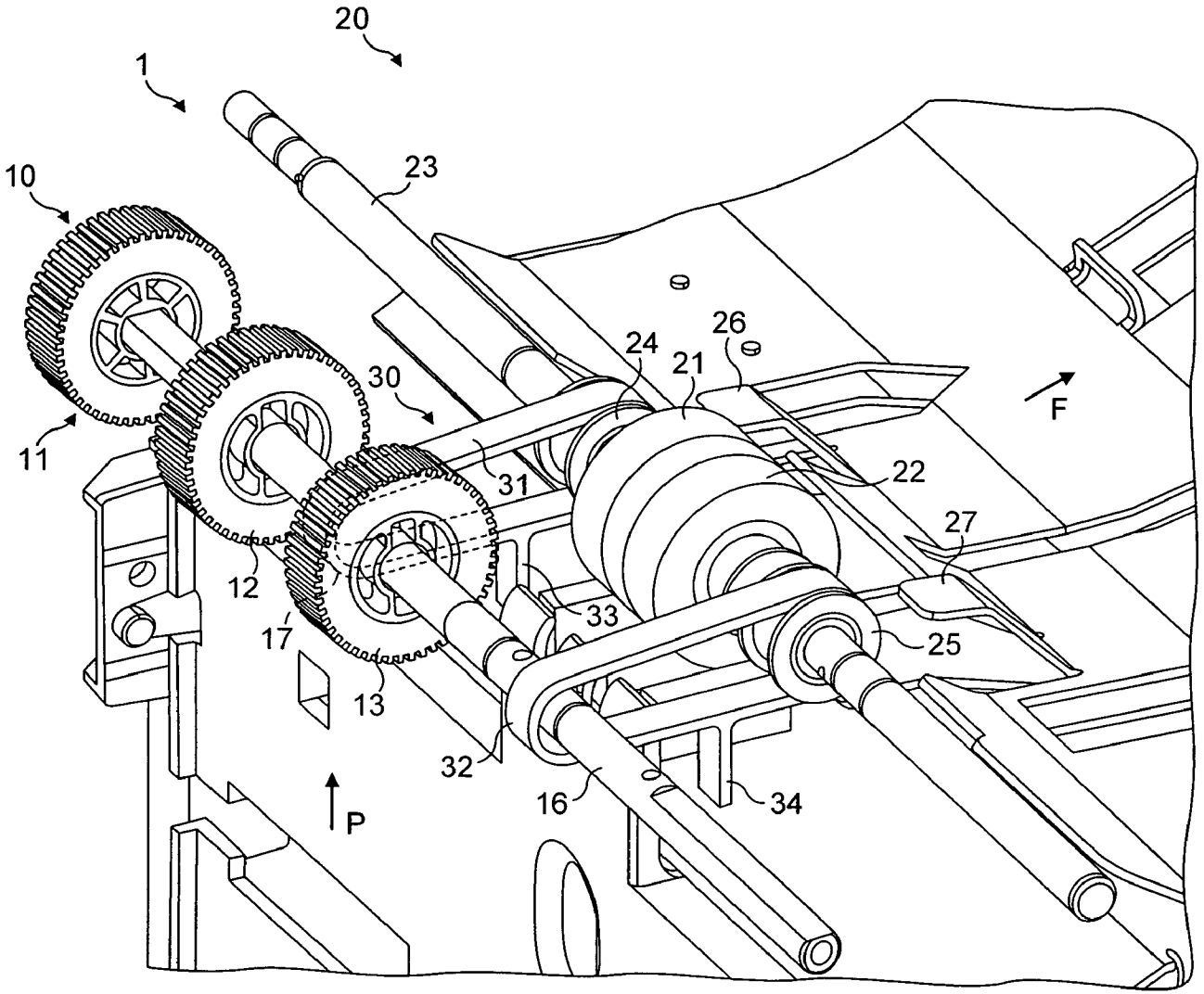
FIG. 1 is a perspective view showing the inlet to the feeder/separator from above and in the feed direction of the envelopes.
Figure 2:
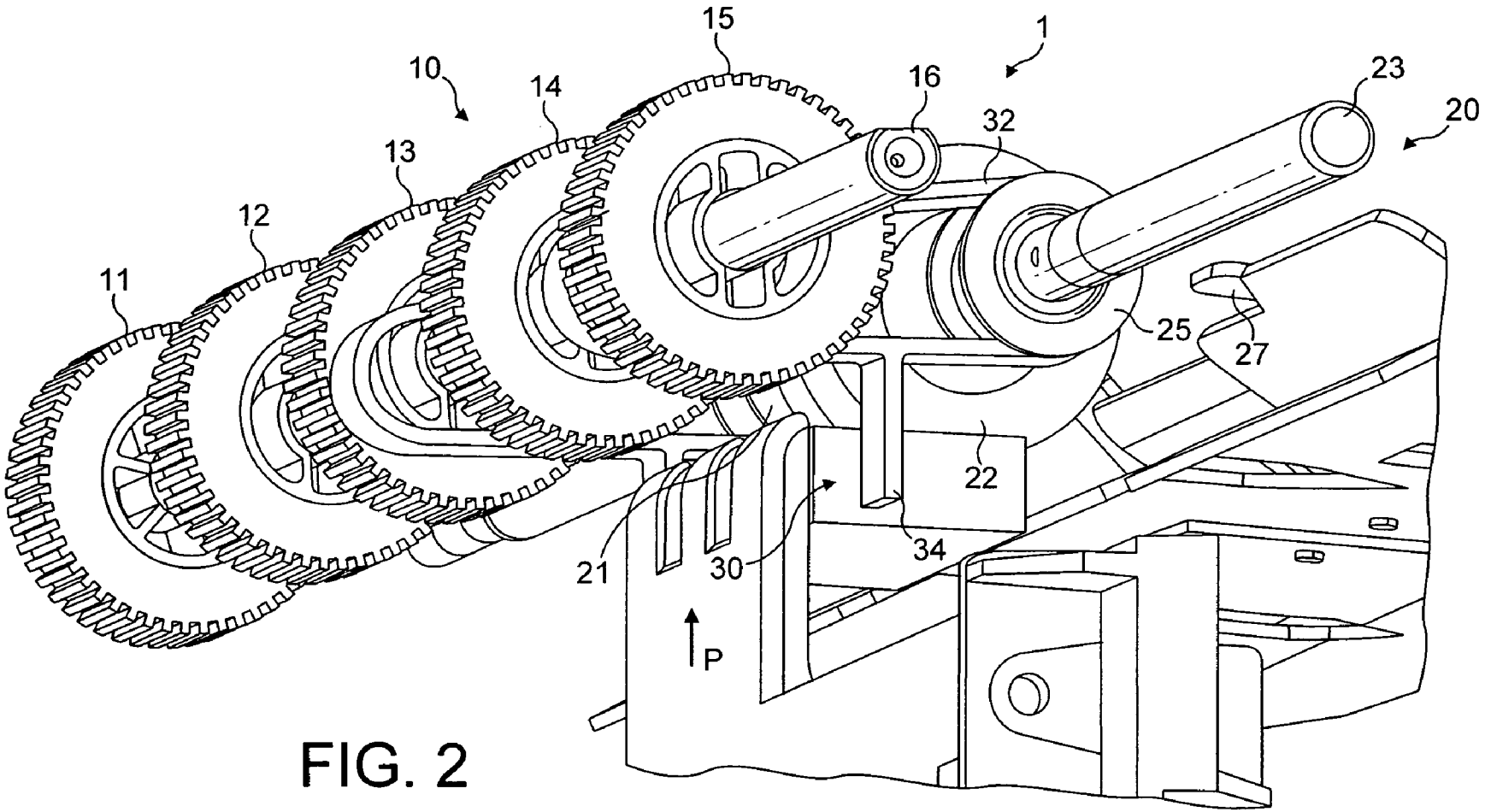
FIG. 2 is a perspective view showing the feeder/separator from below and in the feed direction of the envelopes.
Figure 3:
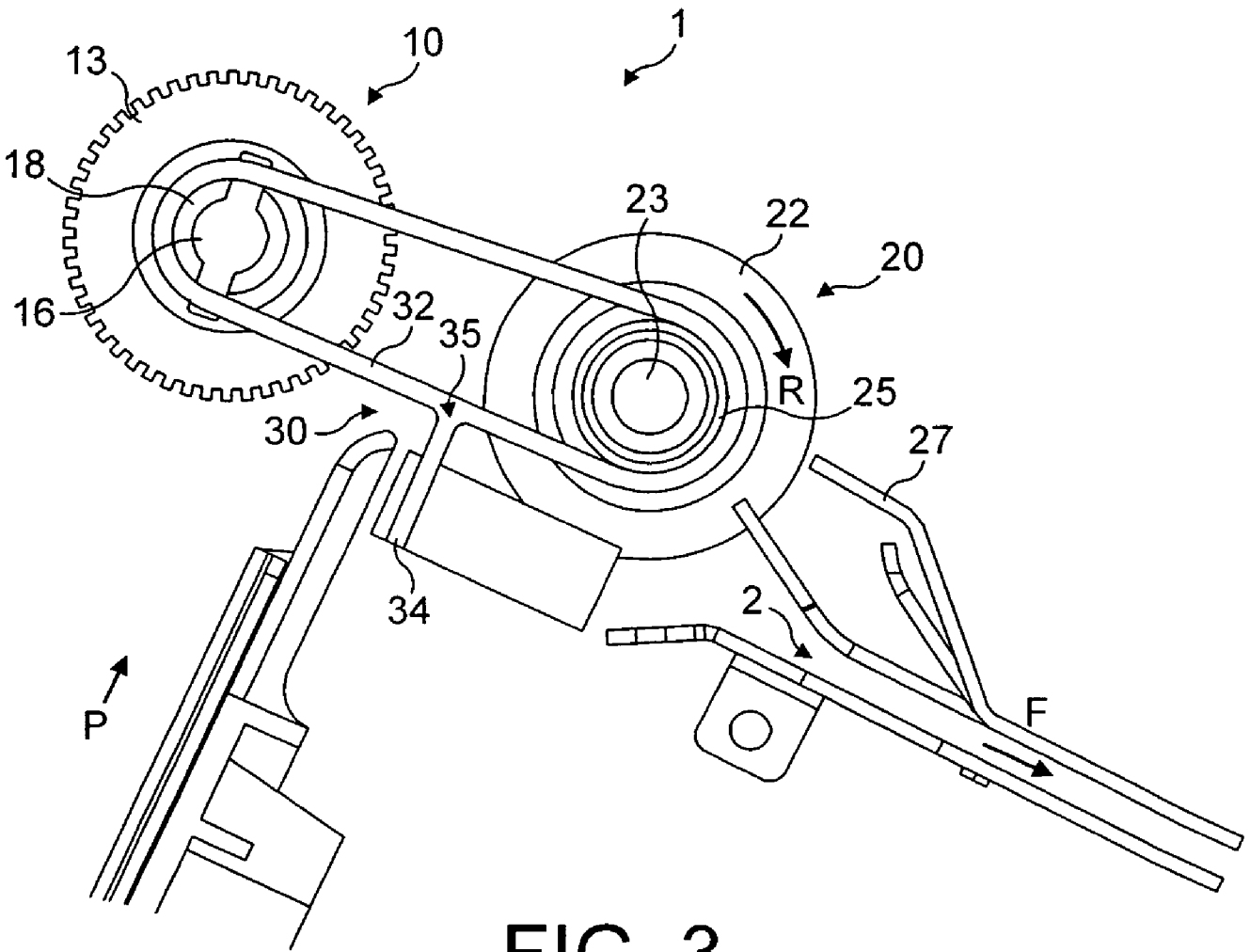
FIG. 3 is a side view of the feeder/separator apparatus.

In FIGS. 1 to 3 a feeder/separator mechanism is shown for feeding envelopes from an envelope feed-tray or platform (not shown) into an appropriate folder/inserter apparatus. The feeder/separator is designated generally as reference numeral 1, comprising a feeder section 10 and a separator section 20. The feeder comprises corrugated feed rollers 11 to 15 located on a pre-feed shaft 16. The separator comprises two separator rollers 21 and 22 attached to a separator shaft 23. The separator shaft 23 and pre-feed shaft 16 are connected by two plain rubber belts 31 and 32 which form part of a reverse-feed means 30. The belt members 31 and 32 engage the pre-feed shaft 16 around pulleys 17 (see FIGS. 1 and 3) and 18 (see FIG. 3), respectively and engage the separator shaft 23 around pulleys 24 and 25, respectively.

In operation, a plurality of envelopes in a stack on the envelope platform are raised towards the feed rollers 11 to 15 in the platform feed direction P. The feed rollers then engage the uppermost few envelopes in the stack and feed them towards the separator rollers 21 and 22. When the plurality of envelopes reaches the separator rollers, a single one of the plurality of envelopes is fed into the folder/inserter apparatus in the envelope feed direction F (see FIGS. 1 and 3). Of the envelopes initially fed into the separator section 20, only a single envelope is fed immediately into the folder/inserter apparatus by the separator roller, the remaining envelopes being caught by a separator pad located opposite the separator roller. The remaining envelopes are then subsequently fed one-at-a-time into the folder/inserter apparatus by the separator. In this way, it can be certainly assured that during an envelope feed operation of the folder/inserter apparatus, only a single envelope will be fed into the apparatus to the inserting location at any one time.

It should be noted that references to feeding the envelopes "one-at-a-time" to the folder/inserter denote that the envelopes are not overlapped as they pass into the machine. However, subsequent envelopes may be fed into the folder/inserter before the first envelope has been ejected from the machine.

However, if the feeding operation is halted whilst some envelopes still remain at the separator, and the envelope feed platform is lowered, those envelopes trapped at the separator will tend to hang down into the region of the platform runway. This can prevent return of the platform to a feeding position and cause a machine jam.

Attached to the plain rubber belts 31 and 32 are two flippers 33 and 34, respectively. When the platform is lowered, an envelope clearance process is then initiated which clears envelopes from the separator region by driving the rubber belts 31 and 32 in the reverse feed direction R (FIG. 3). This causes the flippers 33 and 34 to engage the remaining envelopes at the inlet of the separator 20 and to return them to the stack of envelopes on the envelope carrying platform. Thus, operation of the reverse-feed means 30 is intended to be activated only upon a command input to the folder/inserter machine to lower the envelope feed platform. When such a command is given, for instance by depression of a relevant button, the platform is lowered and the separator shaft is caused to rotate in the reverse feed direction, returning any remaining envelopes to the stack of envelopes on the envelope-carrying platform.

In normal feeding operation of the feeder/separator 1, then the flippers 33 and 34, as well as the belt members 31 and 32, are positioned out of the envelope feed path in order to prevent them from engaging with the incoming envelopes as they are fed towards the separator 20. Pulleys 17 and 18 on the pre-feed shaft 16 are free to rotate and do not apply or receive any significant torque to or from the pre-feed shaft 16. By contrast, pulleys 24 and 25 on the separator shaft 23 are attached via one-way clutches to the shaft. In forwards (feeding) operation of the feeder/separator, the pulleys 24 and 25 exert little or no force on separator shaft 23, and the rubber belts 31 and 32 remain stationary, with flippers 33 and 34 held away from the envelope-feeding region by stops 26 and 27 formed as part of the separator.

In the present embodiment, the separator mechanism is formed from a pair of separator rollers 21 and 22. These rollers may be formed as two independent separator rollers, or may be formed as a unitary body having a central circumferential groove therebetween. The rollers intermesh loosely with the separator pad 29, which is formed as a cuboid block having two grooves therein into which the separator rollers 21 and 22 are located. Envelopes being fed through the separator section 20 are then forced to adopt an undulating corrugated profile over the three peaks produced in the separator pad 29 and beneath the two separator rollers 21, 22. For this reason, such separators are known as "corrugated separators". Such so-called corrugated separators are particularly useful for separating folded sheet material, such as envelopes, etc. as the corrugated profile gives the sheet material extra strength in the longitudinal direction as it passes through separator 20, to thereby resist unwanted folding and creasing of the sheets.

Figure 4A:
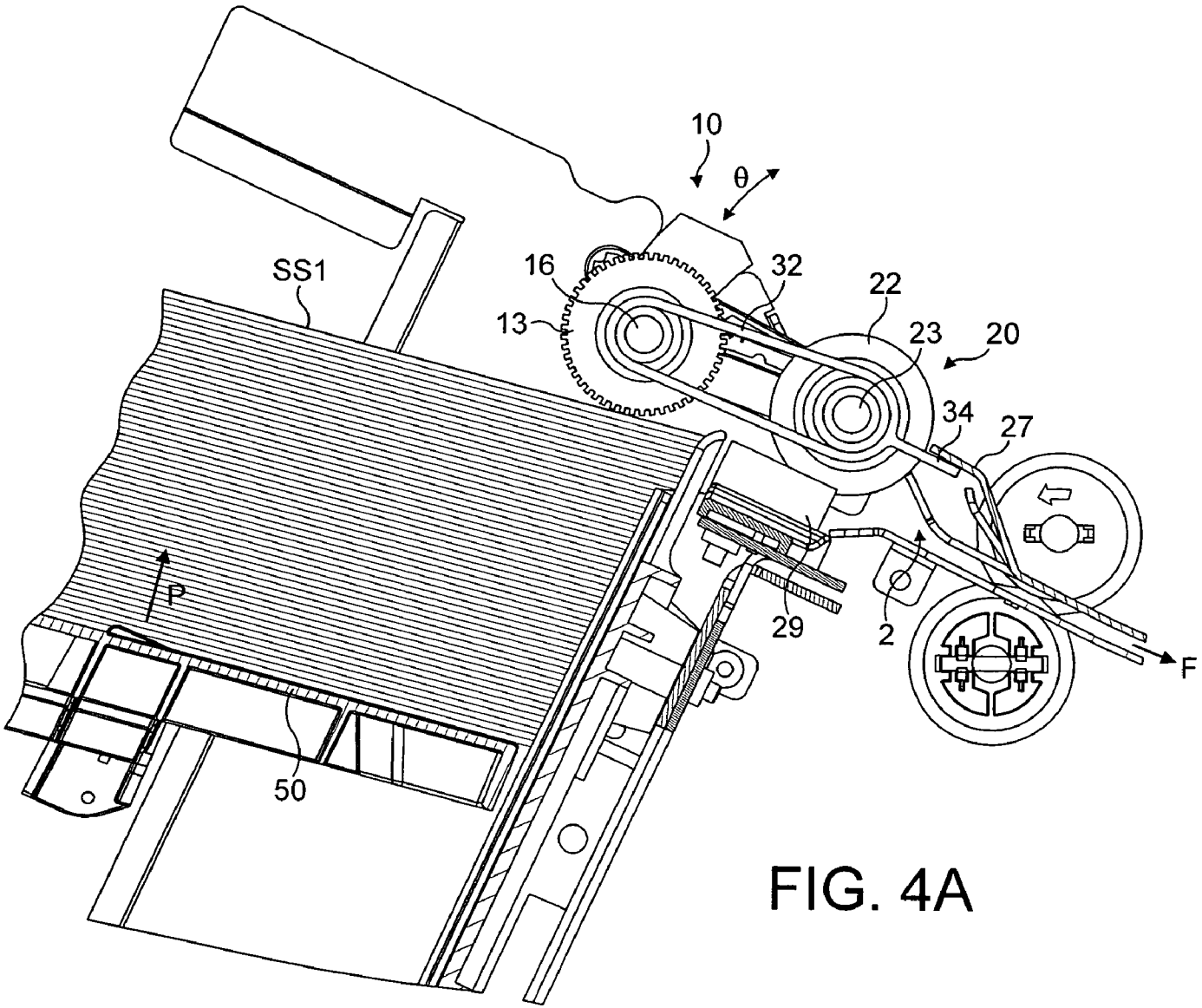
FIG. 4A to 4D is a sequence of views showing a feeding operation of the feeder/separator.
Figure 4B:
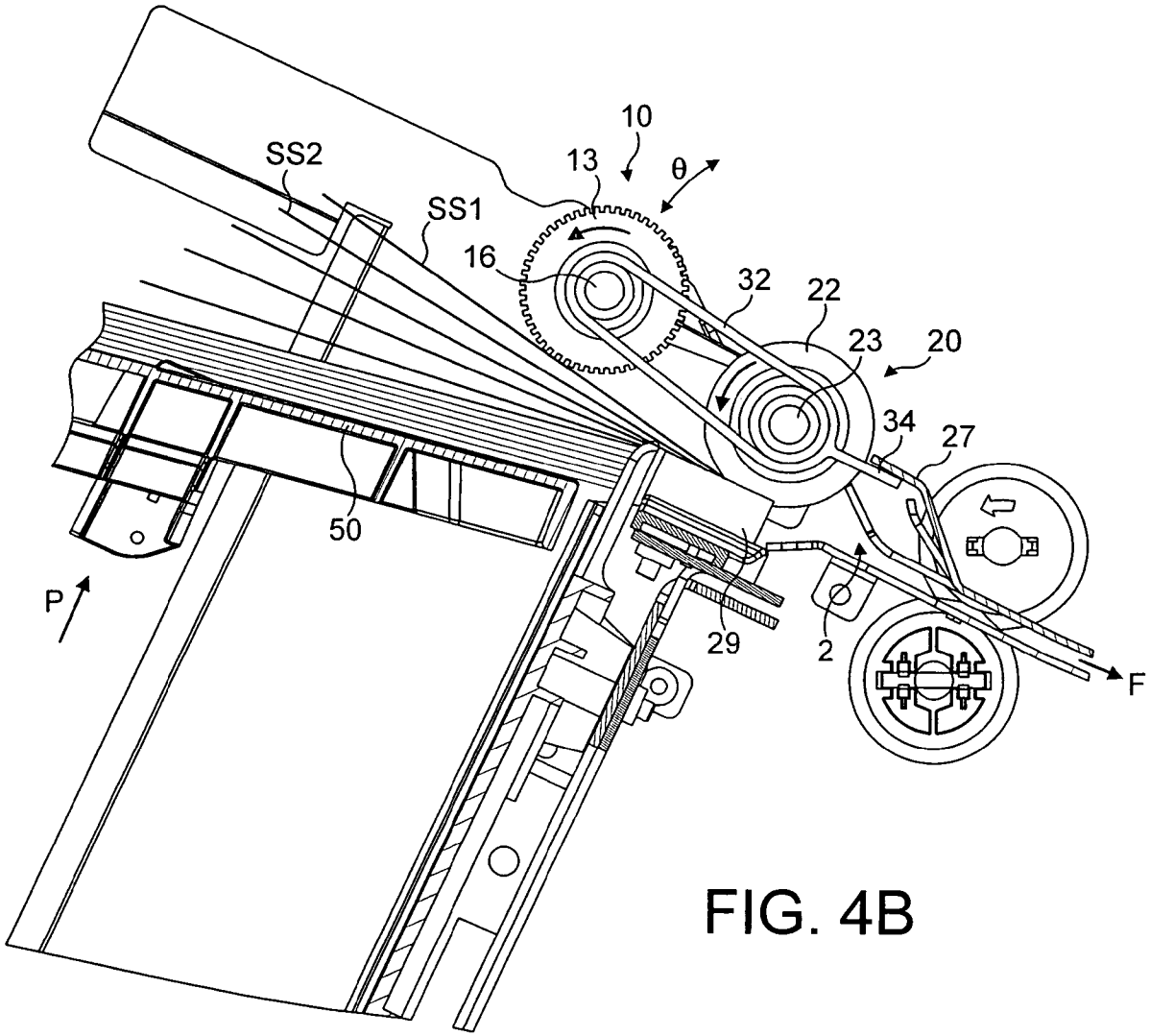
Figure 4C:
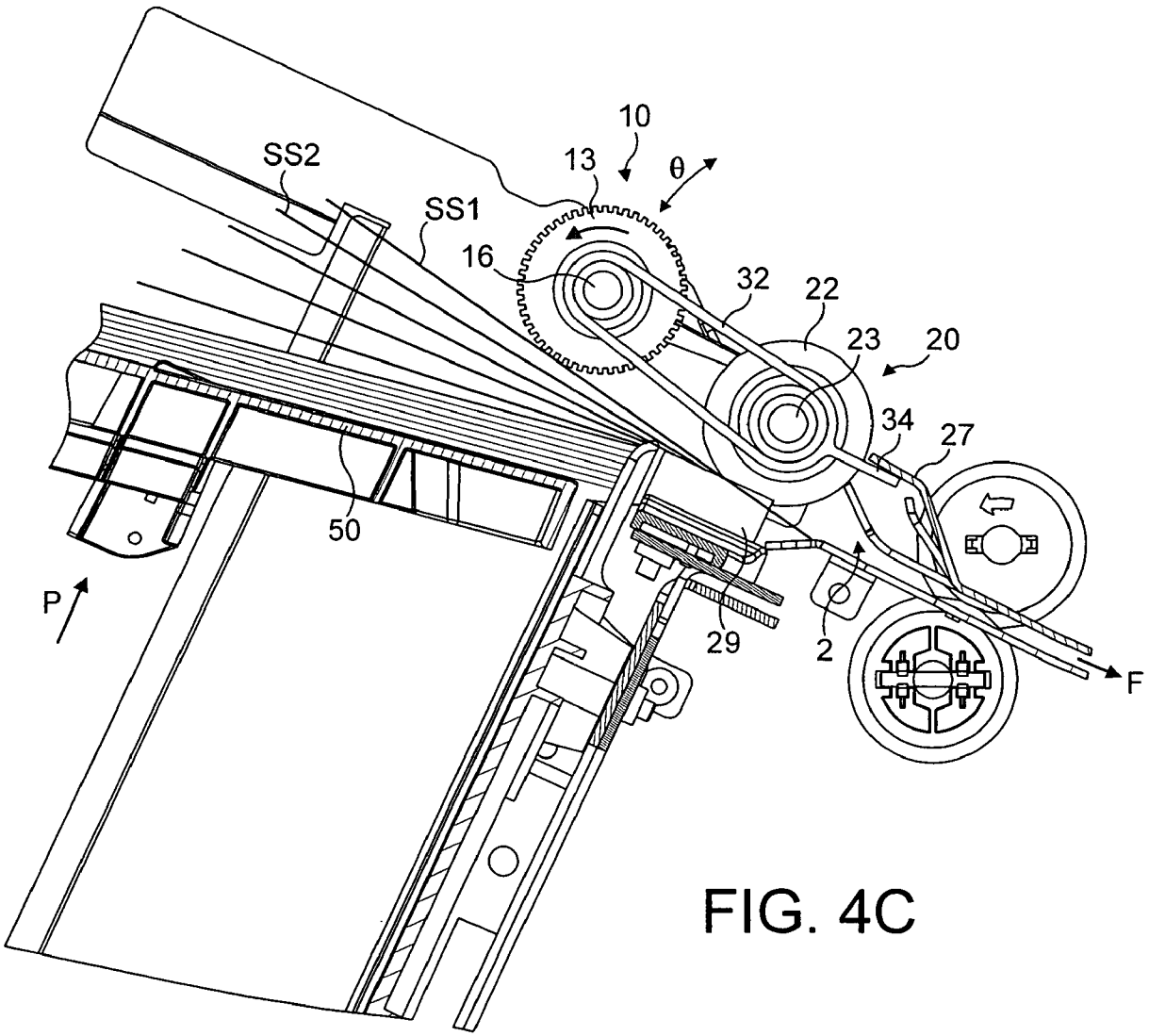
Figure 4D:
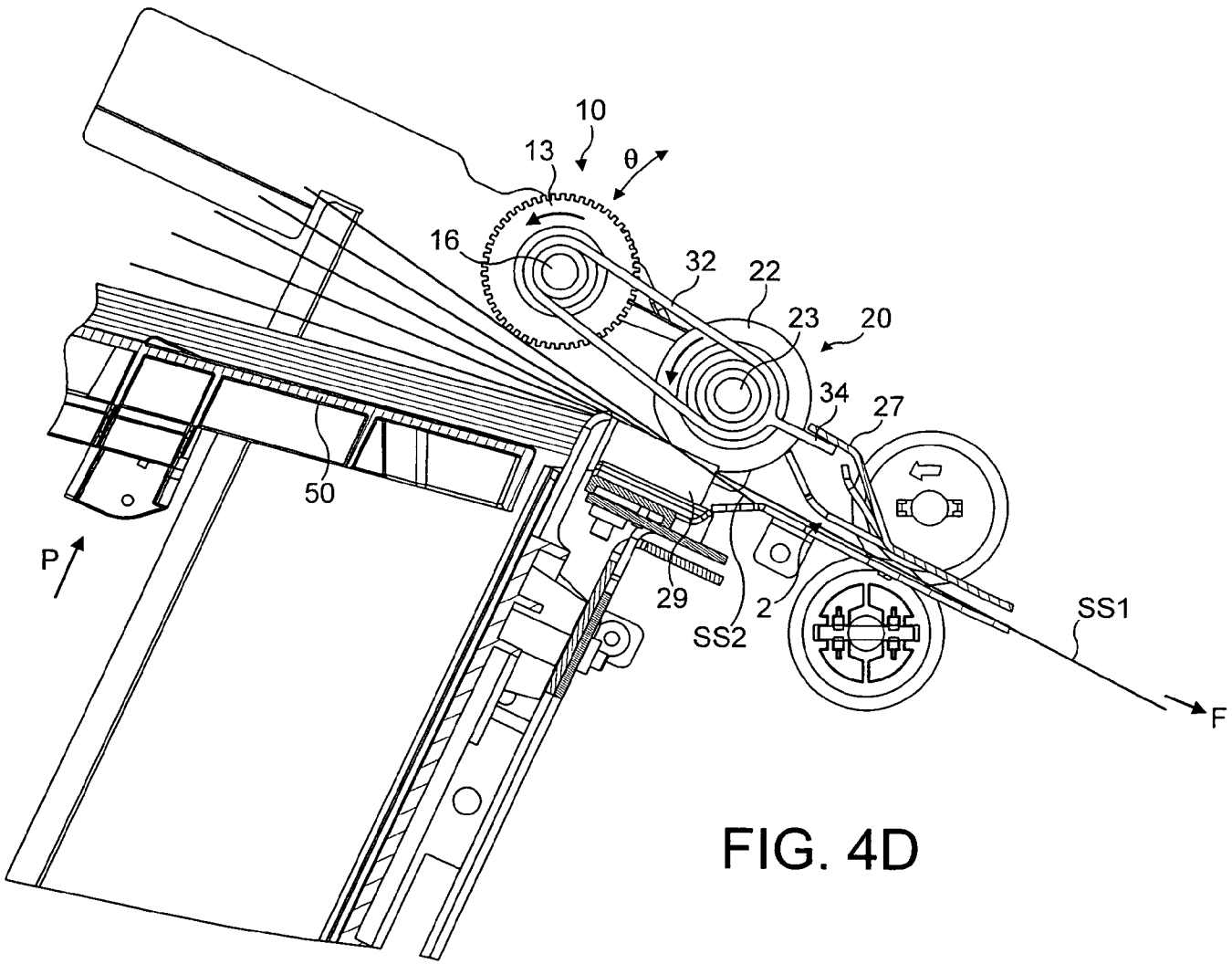

Referring now to FIGS. 4A to 4D, the normal feeding operation of the feeder/separator 1 will be described in detail. As seen in FIG. 4A, a plurality of envelopes are placed in a substantially vertical stack upon platform 50. Platform 50 is raised to bring the top envelope 531 in the stack into contact with the pre-feed rollers 11 to 15 (although only roller 13 is depicted in FIGS. 4A to 4D). In order to achieve a good contact with the envelopes, the pre-feed rollers 11 to 15 are biased by their self-weight against the top of the envelope stack. However, to ensure that the envelopes are correctly positioned prior to and during feeding, the separator mechanism 10 is able to rotate around an axis co-axial with the axis of rotation of the separator shaft 23. This arcuate motion is denoted in FIGS. 4A to 4D by the arrow labelled E. As shown, the continued upward pressure caused by lifting of platform 50 forces the envelopes in the stack against pre-feed rollers 11 to 15, causing the pre-feed mechanism to rotate along the arcuate path E. As shown in FIG. 4B the top few envelopes are fed by the pre-feed mechanism 10 to the separator mechanism 20. In FIG. 4B two envelopes SS1 and SS2 are shown being fed to the separator roller 22 by the pre-feed roller 13. As the envelopes become trapped under the separator rollers 21, 22, the top few envelopes are caused to pivot about their leading edges, resulting in a fan-like expansion of the top few envelopes. This causes further upward motion of pre-feed system 10 about the axis of rotation of separator shaft 23 along the arcuate path θ. This ensures that the pre-feed rollers 11 to 15 contact the envelopes with the desired pre-determined biasing force due to their self-weight, and also that the pre-feed rollers engage the envelopes near to the envelope leading edge in order to provide a controlled drive force to the envelopes. When the top envelope SS1 passes through the separator mechanism 20 between feed rollers 21 and 22 and separator pad 29, it is guided into the envelope feed path 2 before being fed into the folder/inserter apparatus in envelope feed direction F. As is seen in FIG. 4D, as the first envelope SS1 is fed along the envelope feed path 2 in the feed direction F, the second envelope SS2 becomes retarded by the separator section 20, allowing only the first envelope SS1 to be fed along the feed path 2. In order to assist in halting the second envelope SS2, the separator rollers 21,22 are braked when the first envelope SS1 has passed, by shorting-out the separator roller motor(s) so that the back EMF halts the second envelope SS2. This prevents the second and subsequent envelopes from being "pulled" through the separator by feed rollers downstream of the separator rollers 21,22. Second and subsequent envelopes SS2, etc. can subsequently also be fed one-at-a-time along the path 2 from the intermediate staging position where they are engaged by the separator section 20, as shown in FIG. 4D. Thus, in normal feeding operation, envelopes continue to be fed one-at-a-time from the stack by the pre-feed section 10 and through the separator section 20 to the folder/inserter apparatus.

When the reverse-feed means 30 is activated, in order to clear envelopes when the envelope feed platform is lowered, the separator shaft rotates in the reverse feed direction R and the one-way clutches of pulleys 24 and 25 engage to rotate belts 31 and 32. This causes flippers 33 and 34 to disengage from stops 26 and 27 and to then return any remaining envelopes to the envelope feed platform, thereby preventing interference with the platform mechanism and reducing the potential for paper jams within the apparatus.

Figure 5A:
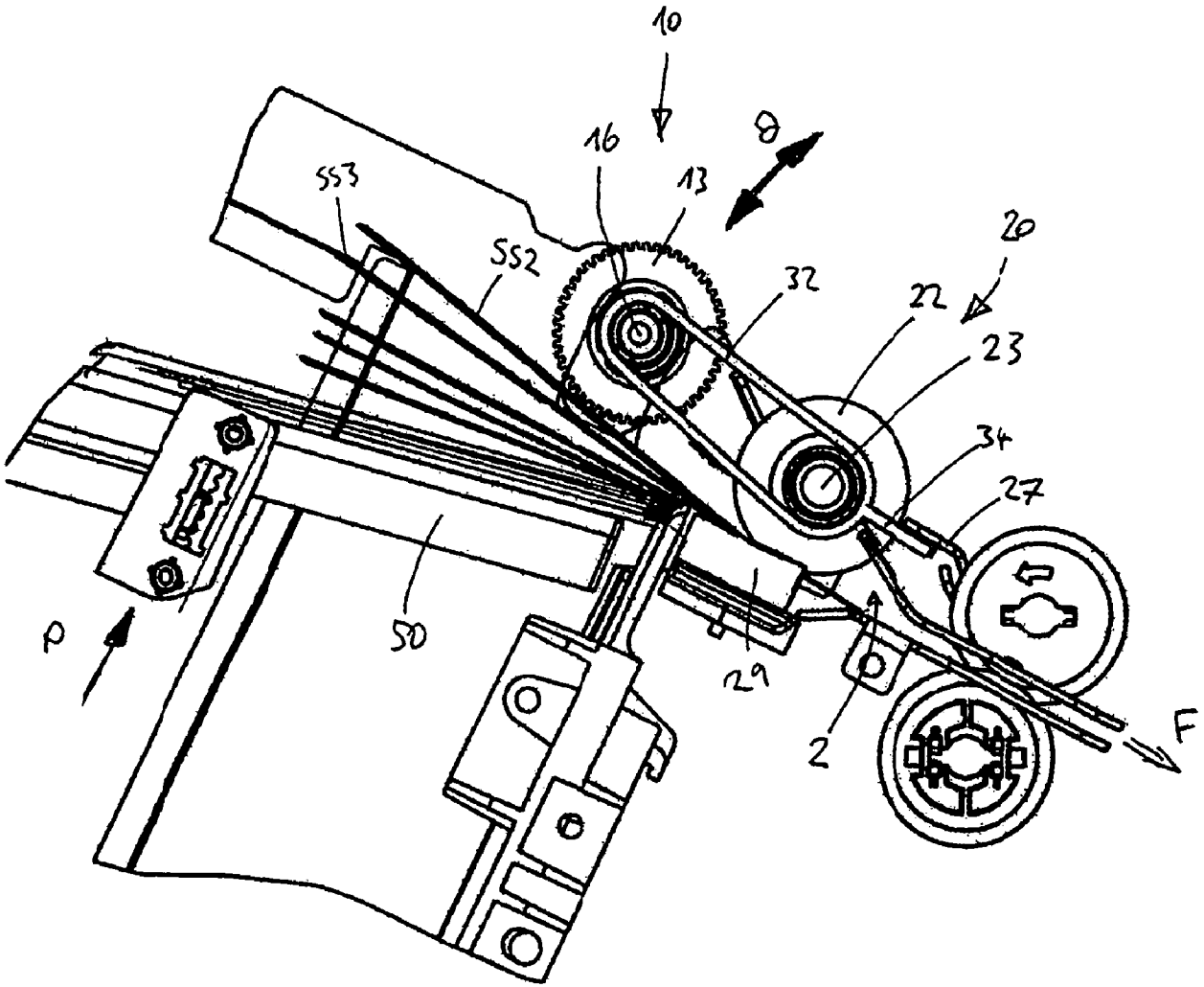
FIG. 5A to 5C is a sequence of views showing a reverse feed operation of the feeder/separator.
Figure 5B:
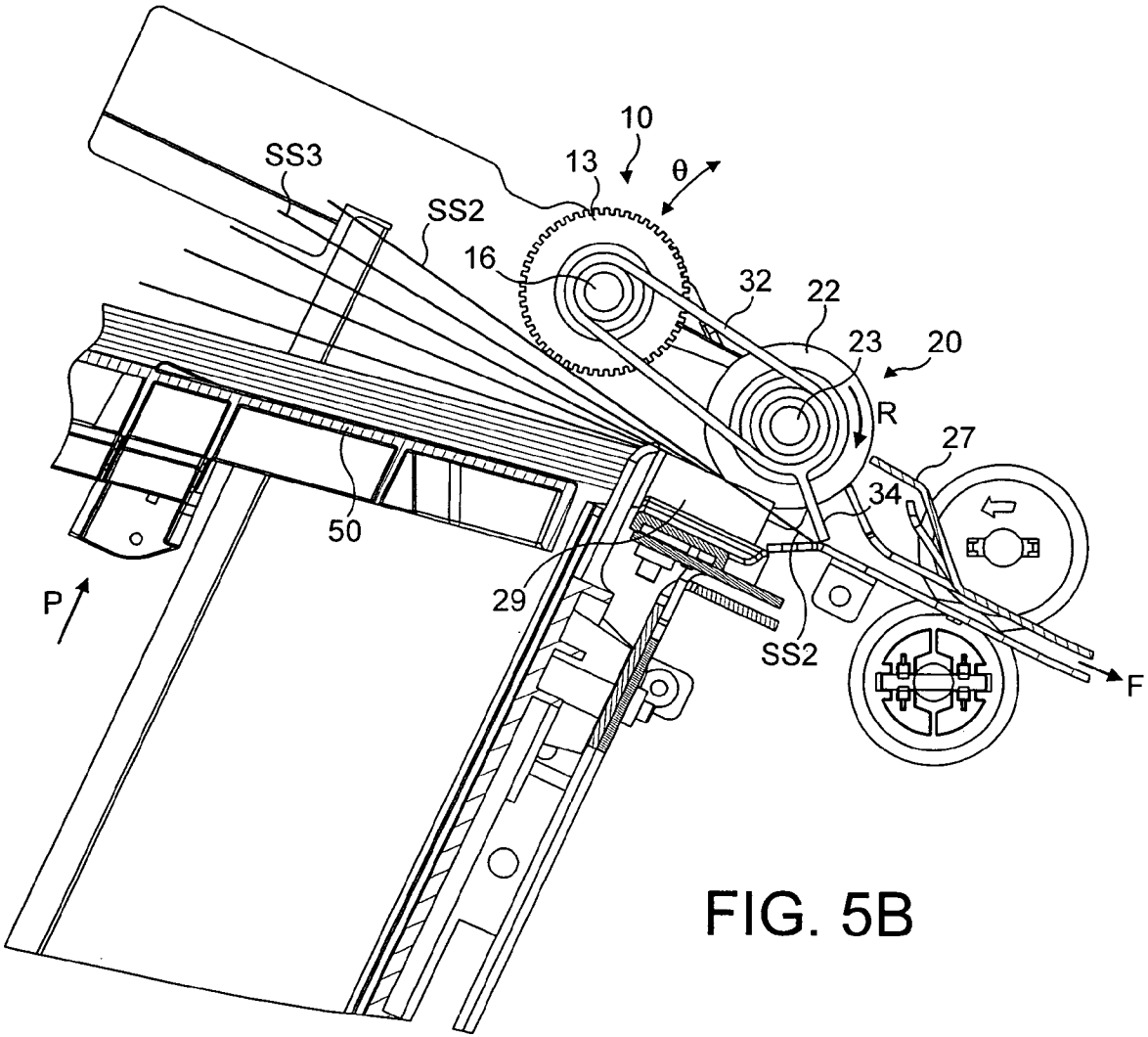
Figure 5C:
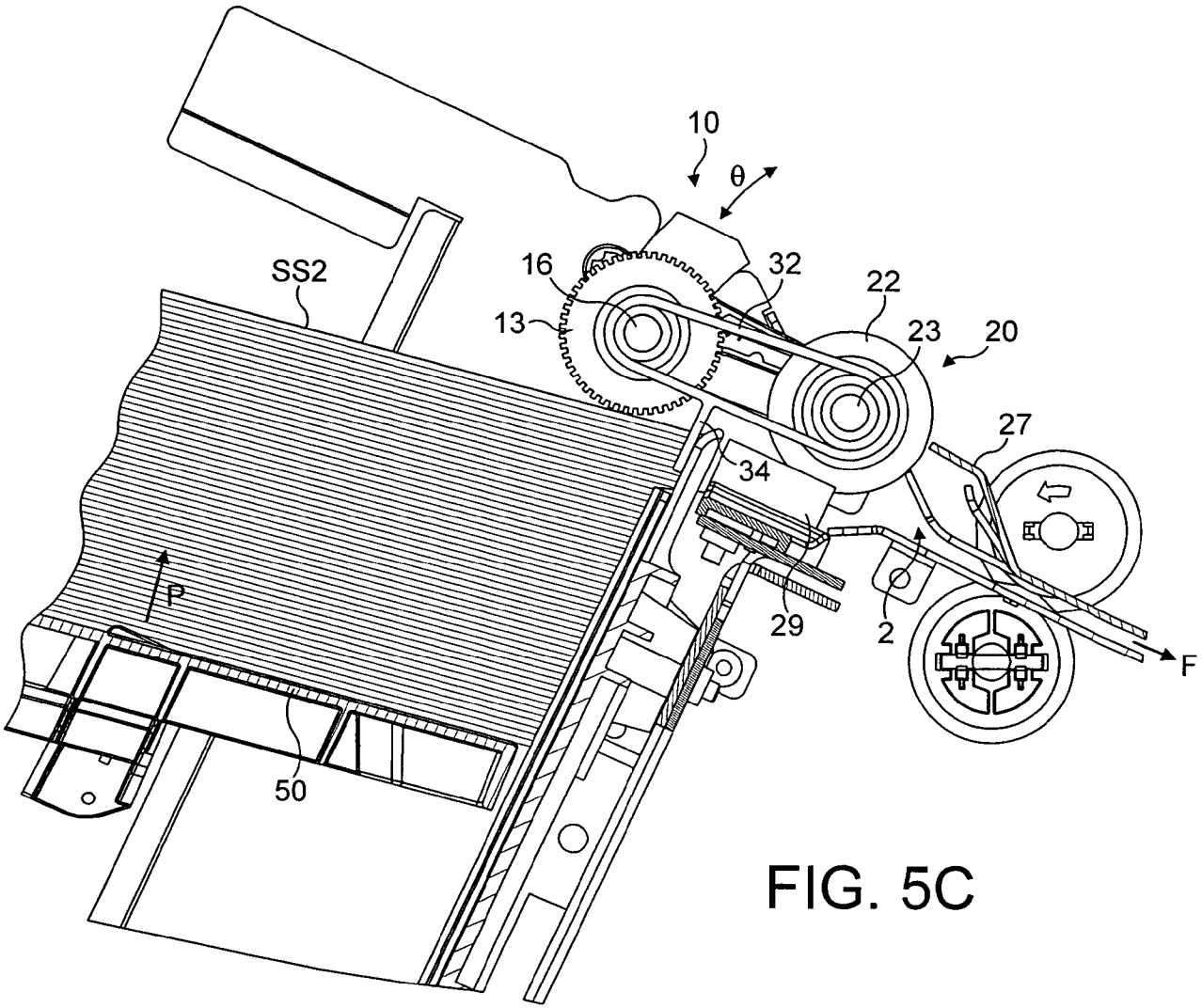

Referring now to FIGS. 5A to 5C, the reverse-feed return mechanism of the envelope feeder/separator 1 will now be described in detail. As shown in FIG. 5A, the feeder/separator mechanism has been halted with an envelope SS2 trapped within the separator section 20. The command is then given for platform 50 to be lowered in the opposite direction to lift direction P. This then initiates the reverse feed mechanism to return the envelope SS2 (and any others) to the stack of sheets supported by platform 50. As shown in FIG. 5A, both rollers are halted, with sheets SS2 and SS3 trapped between the pinch of separator pad 29 and separator rollers 21 and 22 (only roller 22 is visible in FIG. 5A). A reverse-feed process then occurs in which feed rollers 21 and 22 are caused to rotate in the reverse direction R under a limited torque, as discussed previously herein. Simultaneously, belts 31 and 32 (only belt 32 is shown in FIG. 5B) also rotate in the reverse feed direction R. This causes the flippers 33 and 34 to move away from stops 26 and 27. As shown in FIG. 5B, the belt 32 has rotated to move flipper 34 away from stop 27 and into contact with envelope SS2 at the envelope lead edge. Belt 32 and flipper 34 then continue to rotate, as shown in FIG. 5C, thereby returning envelopes SS2 and SS3, along with any others, to the stack of envelopes supported by platform 50. The reverse-feed of the envelopes is initially assisted by the reverse-feed of the separator rollers in the reverse-feed direction R. As the envelopes are moved out of the pinch between separator rollers 21 and 22 and separator pad 29, the flippers 33 and 34 then return any remaining envelopes to the stack. As the platform 50 is lowered, either after or simultaneously with the reverse-feed operation, the pre-feed mechanism 10 also falls, along the arcuate path θ about the rotational axis of separator shaft 23. From the position shown in FIG. 5C, the platform 50 is lowered further until contact between the feed-rollers 11 to 15 is broken, and further envelopes may then be added to the stack to replenish the supply of envelopes to the folder/inserter machine 1. Once the envelopes have been neatly returned to the stack, the belts 31 and 32 continue to rotate in the reverse-feed direction R and flippers 33 and 34 are thereby returned to stops 26 and 27 to allow a normal feed process to resume.

In a mechanically simple reverse-feed mechanism, the separator rollers 21 and 22 are simply attached to separator shaft 23 and allowed to rotate in the reverse-feed direction R during a reverse-feed process. However, it is preferable that the pre-feed rollers 11-15 can "push" the envelopes being fed faster than the separator rollers 21, 22 are feeding the envelope, or that a further feed roller located downstream of the separator 20 can "pull" the envelopes being fed faster than the separator rollers 21, 22 are feeding them Therefore, separator rollers 21 and 22 will normally be attached to separator shaft 23 by one-way clutches (not shown), to allow the separator rollers to "over-run" the separator shaft in the feeding direction R. However, in the present embodiment, a compression spring and washer are provided to apply a force against the over-run clutches associated with each of the separator rollers 21 and 22 on the separator shaft 23. These compression springs apply a force sufficient to cause the clutch to become engaged and to rotate in the reverse direction, but only at a limited torque below a predetermined threshold dictated by the compression spring. This reverse rotation of the separator rollers helps to return any envelopes to the feed platform, and particularly those trapped in the nip between the separator rollers. The predetermined threshold torque may be selected as appropriate for the apparatus, taking consideration of separator nip forces, materials selection, etc.

Whilst the reverse-feed means 30 described herein comprises plain rubber belts 31 and 32 each having a single flipper 33 and 34, respectively, there is no strict requirement regarding the form and construction of these separate elements. For instance, although the flippers 33 and 34 are shown to be moulded integrally with the rubber belts 31 and 32, they may also be formed as separate components. Similarly, it is conceivable that the flippers 33 and 34 could be attached to the belt members 31 and 32 in a hinged fashion at the region of the joint (shown as 35 in FIG. 3).

Further, although the belts have been described as rubber (elastomeric) belts 31 and 32, it is envisaged that any suitable material could be used to a form a belt, or that the mechanism could be replaced with, for example, a chain-link belt or other similar device.

Also, the flipper need not be formed from rubber, but should have a construction which is at least partially flexible, and should have a contact surface for engaging the envelopes remaining in the feeder/separator 1 in a manner which will return the envelopes to the stack on the envelope platform through frictional contact.

As described herein the feeder/separator mechanism is shown to have five pre-feed rollers 11 to 15 and two separator rollers 21, 22. However, the construction of the feeder/separator is not critical to the present inventive concept, such that any suitable pre-feed rollers, in any suitable number, may be used, as well as using any suitable type and number of separator rollers. For example, the pre-feed rollers are shown to have tread-like teeth on the outer surface for increasing grip on the sheets being fed, but any suitable design of feed roller may be used. Similarly, the precise construction of the separator 20 is not to be seen as limited to corrugated separators, as many alternative separators exist which may be substituted therefor.

Advantageously, the embodiment disclosed herein uses rubber belts coupled to relatively inexpensive clutching devices in order to provide a reverse feed operation for envelopes. This represents an effective and efficient means for returning envelopes at the inlet to the feeder/separator back to the stack of envelopes on the envelope carrying platform.

Although it is preferred that the reverse-feed mechanism be operated only when the envelope-carrying platform is lowered, it would also be possible to activate the clearance process after each individual envelope has been fed through the separator.

As described, in order to assist the return of envelopes to the platform, the separator rollers may be driven in the reverse direction, but only at a limited torque defined by clutch bearings and a compression spring acting against the separator roller one-way clutch bearings to define a predetermined maximum torque at which the separator rollers will rotate. This advantageously both frees envelopes from the separator roller nips and also helps to thrust them towards the lowered feed platform.

As described herein, a reverse-feed mechanism 30 is used to return envelopes remaining at the separator inlet to the stack of envelopes on the envelope feed platform. It should be noted, however, that the envelope clearance process could also simply remove the envelopes from the separator region. Clearance could equally be achieved by reversing the envelopes in a non-controlled manner, thereby simply ejecting them in the general direction of the envelope feed platform without them rejoining the ordered stack stored on the platform. Alternatively, the remaining envelopes could be cleared simply by removing them from the separator region, for example by ejecting them from the folder/inserter machine in a sideways direction to the envelope feed direction.

Whilst the apparatus described above is an envelope feeder for a folder/inserter machine, the application of the device is not so-limited. Feeders of the present type, utilizing such a clearance process, would find application in any sheet-feeding component of general sheet-handling devices, but particularly those having enclosed feeding locations which have hard-to-access regions requiring clearance.

What is claimed is:

1. A sheet feeder for feeding sheets one-at-a-time along a path comprising:

means for storing a plurality of sheets;

a feeder/separator comprising feeding means for engaging and feeding the sheets from the means for storing and a separator for engaging the sheets fed by the feeding means to thereby feed single ones of the sheets one-at-a-time along the path whilst remaining sheets not being fed along the path are halted by the separator; and a clearance mechanism for engaging said remaining sheets and removing them from the separator region in a sheet clearance process, the clearance mechanism including at least one belt, and at least one one flipper attached to the at least one belt for engaging the remaining sheets to effect clearance of the sheets from the separator region.

2. The feeder according to claim 1, wherein the clearance mechanism comprises a pair of belts each attached to a respective flipper.

3. The feeder according to claim 1, further comprising a one-way clutch which, in use, operates when an envelope is being fed to prevent the clearance mechanism from being active.

4. The feeder according to claim 3, wherein during the sheet clearance process the one-way clutch allows the at least one belt to rotate to cause the at least one flipper to return any remaining sheets to the stack.

5. A sheet feeder for feeding sheets one-at-a-time along a path comprising:

means for storing a plurality of sheets;

a feeder/separator comprising feeding means for engaging and feeding the sheets from the means for storing and a separator for engaging the sheets fed by the feeding means to thereby feed single ones of the sheets one-at-a-time along the path whilst remaining sheets not being fed along the path are halted by the separator;

a clearance mechanism for engaging said remaining sheets and removing them from the separator region in a sheet clearance process, and a one-way clutch which, in use, operates when an envelope is being fed to prevent the clearance mechanism from being active.

6. The feeder according to claim 5, wherein the clearance mechanism includes at least one belt, and at least one flipper attached to the at least one belt for engaging the remaining sheets to effect clearance of the sheets from the separator region.

7. The feeder according to claim 6, wherein, during the sheet clearance process, the one-way clutch allows the at least one belt to rotate to cause the at least one flipper to return any remaining sheets to the stack.

8. The feeder according to claim 5, wherein the clearance mechanism comprises a pair of belts each attached to a respective flipper.

9. The feeder according to claim 8, wherein, during the sheet clearance process, the one-way clutch allows the pair of belts to rotate to cause the flippers to return any remaining sheets to the stack.

10. A sheet feeder for feeding sheets one-at-a-time along a path comprising:

means for storing a plurality of sheets;

a feeder/separator comprising feeding means for engaging and feeding the sheets from the means for storing and a separator for engaging the sheets fed by the feeding means to thereby feed single ones of the sheets one-at-a-time along the path whilst remaining sheets not being fed along the path are halted by the separator;

a clearance mechanism for engaging said remaining sheets and removing them from the separator region in a sheet clearance process, and a limited-torque clutch mechanism which, in use, serves to prevent reverse motion of the separator, but which is biased to allow the separator to reverse when an applied torque is below a threshold level during the sheet clearance process.

11. The feeder according to claim 10, wherein the limited-torque clutch comprises a one-way clutch and biasing means acting against said one-way clutch to allow the one-way clutch to apply a limited torque in the normally inactive direction.

12. The feeder according to claim 10, wherein the separator comprises a separator roller and friction pad for separating individual sheets from a plurality of sheets at the separator.

13. A method of feeding sheets one-at-a-time to a machine, comprising the steps of:

(i) providing a plurality of sheets in a stack;

(ii) engaging sheets in the stack with a feed roller and feeding them through a separator towards the machine;

(iii) engaging sheets being fed through the separator with a separator roller to allow only a single sheet to be fed into the machine and halting remaining sheets at the separator; and (iv) operating a return mechanism to return any remaining sheets to the stack, the return mechanism comprising at least one belt connected to a flipper, the flipper for engaging remaining sheets in the separator and returning them to the stack.

14. The method according to claim 13, wherein selective operation of the return mechanism is controlled by a clutch mechanism.

* * * * *